United States Patent [19]

Kotai et al.

[11] 4,448,107

[45] May 15, 1984

[54] ROUND-HANDLING SYSTEM FOR A MOBILE WEAPON

[75] Inventors: Ferenc Kotai; Markus Spotzl; Erich Drosen, all of Munich; Leo Pongratz, Karlsfeld, all of Fed. Rep. of Germany

[73] Assignee: Krauss-Maffei Aktiengesellschaft, Munich, Fed. Rep. of Germany

[21] Appl. No.: 363,287

[22] Filed: Mar. 29, 1982

[30] Foreign Application Priority Data

Apr. 1, 1981 [DE] Fed. Rep. of Germany ..... 3113027

[51] Int. Cl.[3] ..... F41H 7/06; F41H 7/04; F41H 5/20; F41F 9/06

[52] U.S. Cl. ..... 89/36 K; 89/45

[58] Field of Search ..... 89/45–47, 89/36 K, 33 B, 33 A

[56] References Cited

U.S. PATENT DOCUMENTS

| | | | |
|---|---|---|---|
| 3,162,088 | 12/1964 | Landstrom | 89/45 X |
| 3,724,324 | 4/1973 | Zielinski | 89/45 X |
| 3,986,432 | 10/1976 | Schreckenberg | 89/45 |
| 4,324,169 | 4/1982 | Ruttgerodt | 89/36 K X |
| 4,388,854 | 6/1983 | Dabrowski | 89/36 K X |

FOREIGN PATENT DOCUMENTS

| | | | |
|---|---|---|---|
| 2027586 | 12/1970 | Fed. Rep. of Germany | 89/46 |
| 1938681 | 2/1973 | Fed. Rep. of Germany . | |
| 2433568 | 1/1976 | Fed. Rep. of Germany | 89/45 |
| 3016928 | 11/1981 | Fed. Rep. of Germany | 89/45 |
| 2444247 | 8/1980 | France | 89/46 |

*Primary Examiner*—Donald G. Kelly

*Attorney, Agent, or Firm*—Karl F. Ross; Herbert Dubno

[57] ABSTRACT

A tank turret has a forward crew compartment separated by an armored partition from a rear munitions compartment. The rounds are stored in a nonrotatable sector and are turned toward a space at the centrum of the sector at which a loading device is rotatable to extract rounds from the magazine and feed them through a hole in the partition into the breach opening.

20 Claims, 7 Drawing Figures

ROUND-HANDLING SYSTEM FOR A MOBILE WEAPON

FIELD OF THE INVENTION

Our present invention relates to a weapons carrier and, more particularly, to a round-handling or round-transport system for a barrel-type weapon on a mobile weapons carrier.

BACKGROUND OF THE INVENTION

Mobile weapons carriers, e.g. tanks and other vehicle-mounted cannons comprise barrel-type weapons, e.g. a cannon, a munitions bunker or magazine containing the rounds to be fired and, frequently, means for transferring the individual rounds into the breach of the weapon.

In German open application No. 1,578,093, for example, an automatic loading device is provided for a cannon which utilizes a carrousel magazine which rotates the round-receiving stations past a fixed location at which the rounds can be successively removed from the angularly indexed magazine and transferred to the breach of the cannon. The loading device which effects the transfer is fixed in position, nonrotatable and is adapted to withdraw each round axially from the magazine and swing the round into the breach of the cannon.

This arrangement has the disadvantages that for each loading operation, the entire carrousel must be stepped and hence the entire mass of the munitions carried therein must be accelerated after standstill and braked to align the next round with the transfer mechanism.

Because of the large inertia of the magazine, this operation takes a comparatively long time and the drive and brake mechanism for the carrousel magazine must be comparatively massively dimensioned.

Yet another disadvantage can be found in the fact that a mobile weapons carrier frequently is provided with a variety of munitions for different purposes, ranges or targets, stored in a single magazine.

When it is necessary to select a particular munitions type, therefore, it is frequently necessary to rotate the entire magazine until the particular round reaches the loading position, thereby delaying the loading operation still further.

Finally, a massive rotating carrousel-type magazine requires an expensive drive system and journaling arrangement which must be maintained by time-consuming operations at a high cost, thereby increasing the maintenance downtime of the weapon and reducing reliability in many instances.

It should also be noted that the earlier system occupied an inordinate amount of space which is at a premium in mobile weapon carriers.

OBJECTS OF THE INVENTION

It is the principal object of the present invention to provide a munitions handling system for a barrel-type weapon whereby the disadvantages of this earlier arrangement are obviated.

Still another object of this invention is to provide an improved munitions magazine and loading arrangement for a barrel-type weapon which facilitates access to particular munitions rounds, reduces the loading time to a minimum and requires less space for the munitions bunker and loading mechanism than has heretofore been the case.

Still another object of this invention is to provide a mobile weapons carrier having a compact, reliable and low-maintenance munitions handling system which is of comparatively low cost and which can be operated at greater efficiency with respect to the number of rounds fired per unit time.

SUMMARY OF THE INVENTION

These objects and others which will become apparent hereinafter are attained, in accordance with the invention, by providing especially for a mobile weapons carrier, provided with a magazine containing a number of rounds of munitions for the barrel-type weapon, and a device for moving the rounds from the magazine and feeding them to the breach of the weapon. According to this invention, the magazine has the configuration of an annular sector with its rounds stored in respective compartments oriented so that their axes are directed toward the centrum of this sector, the breach of the weapon also being openable toward the centrum of the space containing the centrum and surrounded by the annular sector. Preferably this space has the configuration of a cylindrical chamber and the axes of the munitions lie in a single plane perpendicular to the vertical axis at this centrum and of this cylinder, or in a plurality of mutually parallel planes perpendicular to this axis while the loading device is journaled in this space about this axis and can be rotated after alignment with a munitions compartment into alignment with the breach of the weapon.

Consequently, in a preferred construction of the present invention, the munitions magazine of annular sectoral configuration is horizontally disposed, thereby enabling it to be located in a turret of a mobile weapons carrier, such as a tank thereby affording a compact means for supplying the rounds to the weapon.

The magazine and the loading device are thereby also easily accessible from above for maintenance and for reloading the round compartments of the magazine, e.g. by removal or opening of a hatch closing the turret from the top.

While the munitions rounds can be inserted individually, it has been found to be advantageous to prepare them in annular sectoral containers which can be loaded into the magazine, e.g. by a crane, with the cover of the turret, at least in the region of the magazine being formed by an upper wall of each container. The upper walls, in this case, are armored. To enable the munitions and the magazine compartments to be handled more easily, these compartments can be detachable or separate from one another and of sectoral shape as previously mentioned.

When only a single magazine body is employed (or prepackaged containers or separable compartments are used), the magazine can be subdivided by radially extending partitions which can prevent an explosion in one section from being transmitted to other sections of the magazine.

According to another feature of the invention, the housing for the magazine is provided with at least one radialy extending loading hatch or opening, aligned with a loading tunnel which can be constituted by one of the round-receiving compartments so that reloading of the compartments of the magazine can be effected by successively feeding the rounds through this tunnel into the loading device by which the rounds are in turn transferred to the other compartments. This eliminates the need to rotate the entire magazine for firing operations or for reloading.

The loading device itself can be moved vertically through a hatch in the roof of the turret through the cylindrical chamber, thereby leaving the chamber space free so that personnel can load rounds into the munitions compartment by hand and to permit maintenance of the breach of the weapon, of the loading device or other parts of the system.

Substantially all of the walls of the munitions magazine, except, perhaps, those defining the cylindrical wall of the chamber, are preferably armored.

According to another feature of this invention, the loading device comprises a cylindrical body which is closed except for the tunnel alignable with the breach and with the round compartments, and which substantially completely fills the cylindrical space. The loading device itself or the tunnel can also be shiftable along its vertical or rotation axis, e.g. for alignment with the rounds in a different layer and with the breach of the weapon, or can be swingable about an axis transverse to the rotation axis. The loading device is thereby readily positioned for extracting rounds from the magazine and feeding them to the breach of the weapon by inexpensive means and in a reliable manner.

Alignment of the loading device with the weapon can be accomplished by conventional simple indexing means or drive arrangements located in the turret or the housing of the mobile unit.

The loading device and the housing can be combined into a unit replaceable on the vehicle for maintenance purposes.

The housing of the loading device, moreover, can be provided with a recess alignable with the weapon to facilitate recoil of the latter without increasing the space occupied by the munitions handling device. This affords an especially compact construction.

It has also been found to be advantageous when munitions of different lengths are to be employed, to reduce the length of the compartments receiving such rounds and thereby conforming the outer contour of the magazine and the housing surrounding them to the contracted length of the compartments in appropriate regions. This is especially advantageous since forward regions of the magazine can be contracted by comparison to rearward regions thereof as is especially desirable for tank turrets which should have a small area facing fowardly. The lateral surfaces can also be reduced in size by this expedient.

The magazine can also be formed with two or more annular sectors of different outer radii, stacked in a conical configuration, with the smaller magazine receiving shorter munitions of rounds. Alternatively the rounds can be tilted together with their respective compartments slightly to the horizontal.

In general, munition rounds taper from the base to the tip and when munition rounds of this type are stacked in a single compartment, the compartments may taper outwardly thereby reducing the profile of the housing.

According to another feature of the invention, the magazine is located in a tank turret which is journaled at a forward portion thereof and carries a weapon whose elevation can be controlled by tilting it on trunnions about a horizontal axis, the turret having a rearwardly extending tail portion which can be formed with the magazine and the aforementioned cylindrical space so that the weapon and the magazine swing together with the turret for traversing the weapon.

Preferably, the openings of the rounds compartments lie in the plane of the barrel of the weapon when the latter is horizontally oriented.

Preferably the interior of the turret is subdivided by an armored partition into a forward crew compartment and a munitions-loading compartment occupying the rearward portion of the turret.

The crew compartment is provided, of course, with the breach block and firing mechanism for the weapon, including a targeting system which may be desired while the partition is formed with an opening substantially aligned with the breach of the weapon in the horizontal position thereof, through which the rounds can be fed into the breach. This opening can have a door or other closure which preferably is also armored.

For still better protection of the crew compartment from an explosion in the munitions compartment, the only opening in this partition or wall can be confined to an opening of a diameter just sufficient to clear the munitions.

In this embodiment of the invention, in contrast with the embodiment previously described, the loading device need not assume any explosion-resistant or protective function and thus need not be a housing structure completely filling the cylindrical space. The loading device can thus be significantly lighter and can rotate substantially faster whereby both loading of the rounds into the magazine and loading of the rounds from the magazine into the weapon can be speeded up.

Another advantage of this arrangement is that the armored function of the partition is always in place and is effective whether or not the loading device is in position or regardless of the orientation of the loading device except that the protective effect is reduced slightly when the loading devices align with the opening in the partition.

Another feature of the invention resides in providing the loading device as a rotatable stage which can be driven about a vertical axis and which is formed with a loading tube swingabout about an axis perpendicular to the axis of rotation of the stage, i.e. about a horizontal axis which is also parallel to the axis of the loading tube, whereby the loading tube can be raised or lowered to the level of the rounds in their respective compartments and to the opening in the partition.

The loading tube can be carried by a pair of pivotal arms and it has been found to be advantageous to provide two parallel loading tubes on these arms so that two munitions rounds can be retracted from the magazine simultaneously and one loaded through the opening into the weapon to be followed rapidly by the other. This, of course, speeds up the sequence of firing between successive rounds.

To minimize the front silhouette of the turret, the annular sectoral magazine can be provided with lateral gaps at which the turret housing is contracted so that the width of the turret can be less than twice the radius curvature of the outer parameter of the magazine. The free space provided by the interruptions can form buffering compartments which have been found to be advantageous when the carrier is attacked by hollow charge projectiles since the latter are generally directed at the flanks of the turret and because of the presence of the buffering compartments will have little effect on the crew compartment.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figures 1, 2:
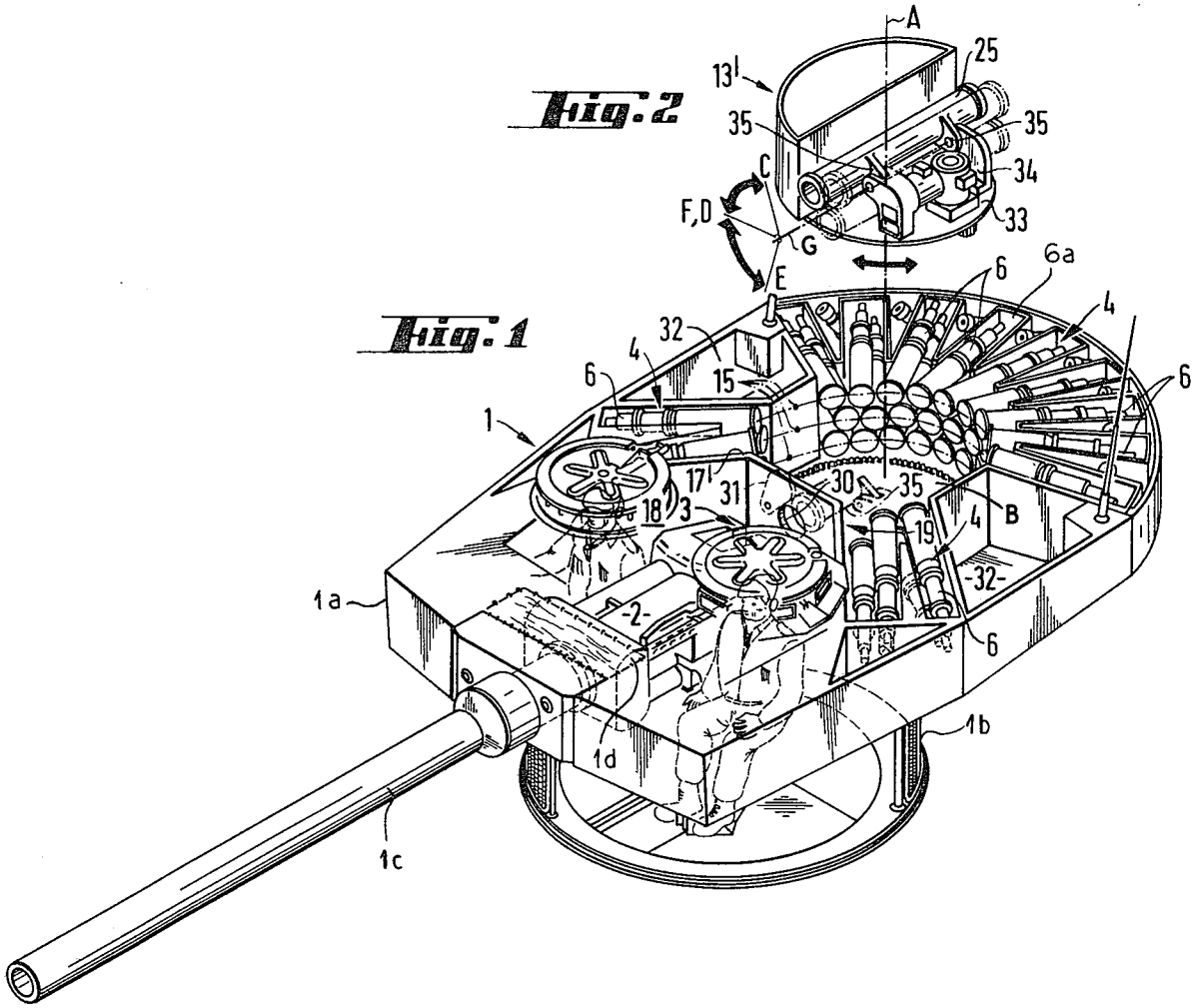
FIG. 1 is a top perspective view, partly broken away and in highly diagrammatic form, of a turret provided with a munitions-handling system according to the invention from which the loading device has been removed.
FIG. 2 is a perspective view of the loading device in the position thereof in which it can be lowered into the turret.

The turret 1 for a tank as shown in FIG. 1 comprises a housing 1*a* mounted upon a rotatable column 1*b* in a conventional manner upon the tank body (not shown) and is provided with an armored wall 17' subdividing the interior of the turret into a forward crew compartment 18 and a munitions compartment 19. The turret is rotatable about an axis located generally in the crew compartment and carries a weapon 1*c* in the form of a cannon which can be swung upwardly and downwardly on a trunnion arrangement 1*d* of conventional design and shown only diagrammatically. Also diagrammatically shown are the crew stations for navigating the vehicle, sighting and firing the weapon and controlling the other conventional operations of the tank.

The breach mechanism 2 of the cannon 1*c* extends into the crew compartment and, in the horizontal position of the cannon, has its breach 3 aligned with an opening 30 in the wall 17', this opening being dimensioned to allow the weapons rounds 6 to be fed into the breach of the cannon.

Armored cover 31 can be swung downwardly from the position shown in broken lines in FIG. 1 to close the opening 30.

The munitions compartment 19 is provided with an annular sectoral magazine 4 interrupted by lateral compartments 32 which are likewise armored and serve as bigger compartments in the manner previously described.

At the centrum of the magazine 4 a chamber of cylindrical configuration around a vertical axis A is provided to receive the loading device 13' shown in FIG. 2.

This loading device which can be removed from the turret for maintenance or repair has been shown out of the turret in FIG. 2 but operates when received in the cylindrical space B.

The loading device 13' comprises a turntable 33, rotatable about the vertical axis A and provided with a swinging unit 34 comprising a pair of arms 35 pivoted about an axis G which is parallel to the axis of the gun in the horizontal position of the latter. This axis is also parallel to the axis of a loading tube 25 carried by the arms 35 and swingable into alignment with the rounds stored in the magazine.

As can be seen from FIG. 2, the loading tube 25 can thus be swung about the horizontal axis 6 to the levels C,D,E and F which can correspond to the levels of the stacked munitions and the opening 30.

In accordance with conventional principles and as described, for example in the commonly assigned copending application Ser. No. 318,989 filed Nov. 6, 1981, the loading tube can be of the telescoping type for picking up and transferring the munitions rounds.

The rounds 6 are stored in a generally radial compartment 6*a* in the rear of the turret which is cantilevered on the column 1*b*.

Loading of the rounds into the round compartment may be effected by the means previously described and unloading for firing purposes is effected by aligning the firing tube 25 with a selected round and rotating the device 13' to position the round aligned with the opening. The round is then transferred through the opening 30 into the weapon and as soon as the round leaves the tube 25, the latter is rotated into alignment with another round of the magazine to pick up the latter.

Figures 3, 4:
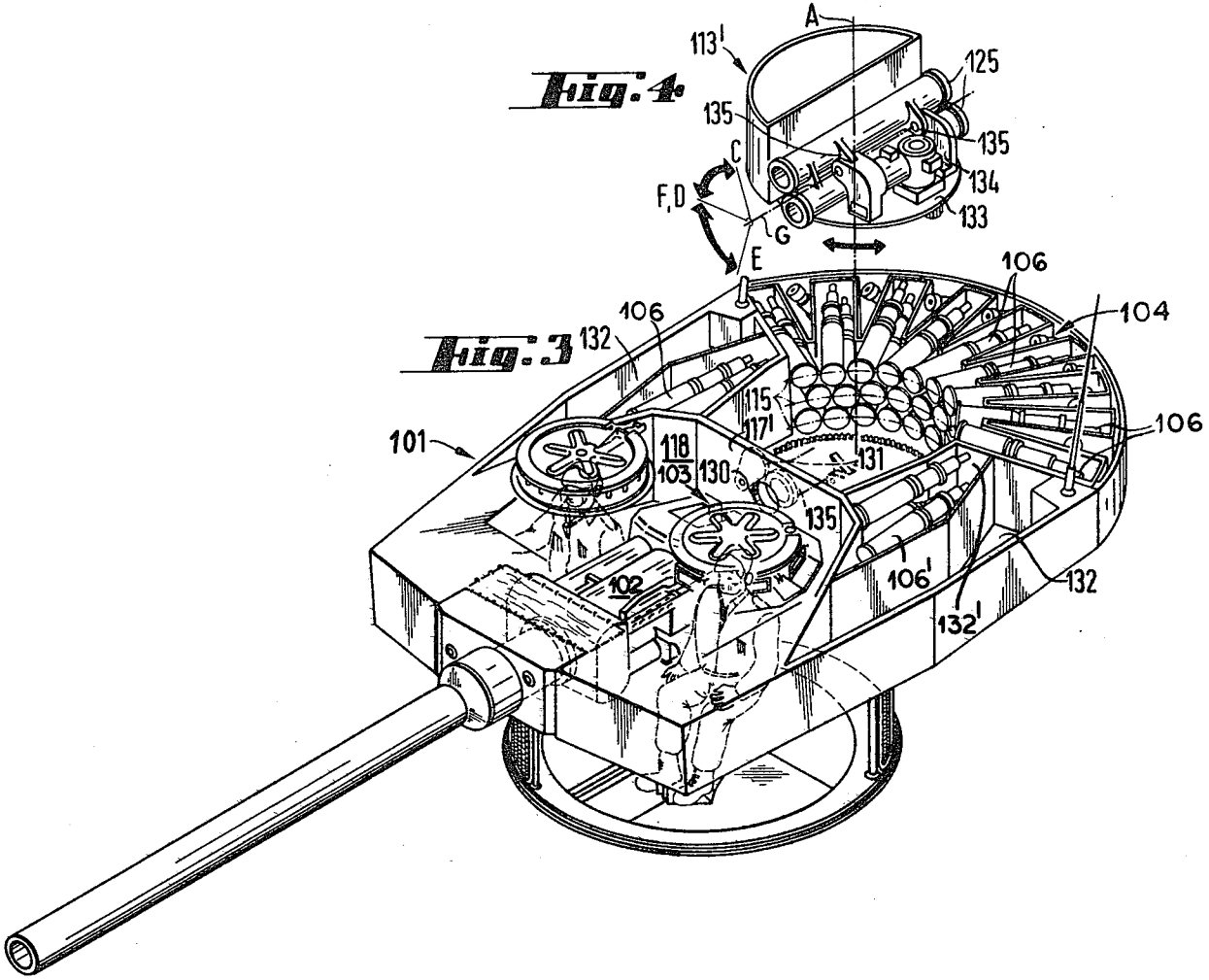
FIG. 3 is a view similar to FIG. 1 illustrating another embodiment of the invention, also with the loading device removed.
FIG. 4 is a perspective view of this loading device.

In the embodiment of FIGS. 3 and 4, the lateral compartments 132 extend over the entire flanks of the turret from the magazine 104 forwardly to protect against hollow charge projectiles. The magazine 104 is thus located exclusively at the rearmost portion of the heel of the turret 101. The entire rear portion or magazine can be connected to the forward portion of the turret by explosively released fasteners operated by sensors responsive to an incipient explosion in the magazine, e.g. by detection of temperature and pressure therein. In this manner, the magazine may be blown away from the turret in the event of such danger.

It is possible to provide additional munitions storage in this embodiment by providing additional rounds 106' in compartments 132' flanking the buffer compartments 132, these rounds being utilized in emergencies and being readily accessible for manual loading. The outermost portions of the buffer chambers can be used to accomodate other devices which may be necessary for operation of the tank. In this embodiment, as in the embodiments of FIGS. 1 and 2, the loading device 113' can be employed. This device differs from that of FIGS. 1 and 2 in that two loading tubes 125 are provided on the pivotal arms 135 of the swinging device 134 and the turntable 133.

In this case, two rounds 106 at two different levels 115 can be withdrawn from the magazine so that they can be fed to the breach of the weapon one after the other in succession without rotating the loading device. Naturally, three such tubes can also be provided to increase the rapidity of successive firing with at least three rounds.

The other elements in FIGS. 3 and 4 correspond to the similarly numbered elements in FIGS. 1 and 2 where the levels at which the rounds were stored have been represented at 15.

Figure 5:
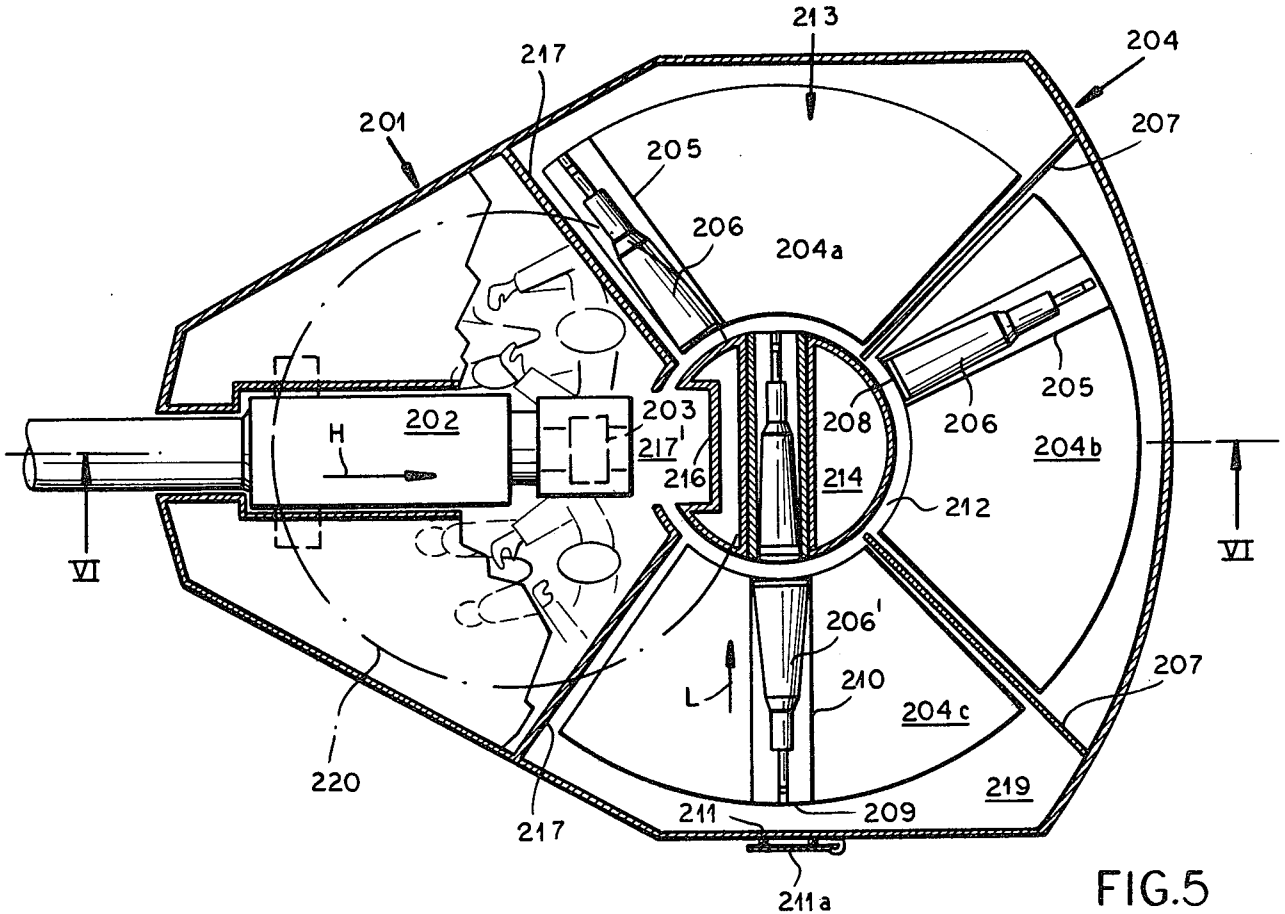
FIG. 5 is a plan view illustrating yet another embodiment of the invention with parts broken away.
Figure 7:
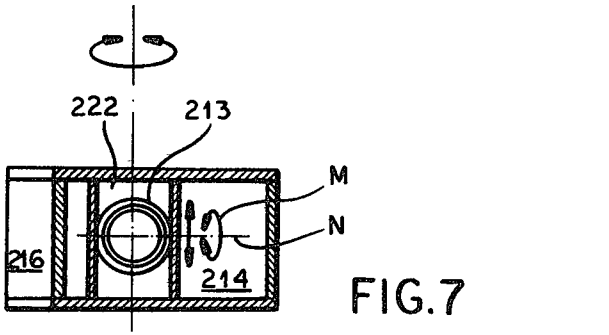
FIG. 7 is a detail view, in section, of the loading device from the embodiments of FIGS. 5 and 6.
Figure 6:
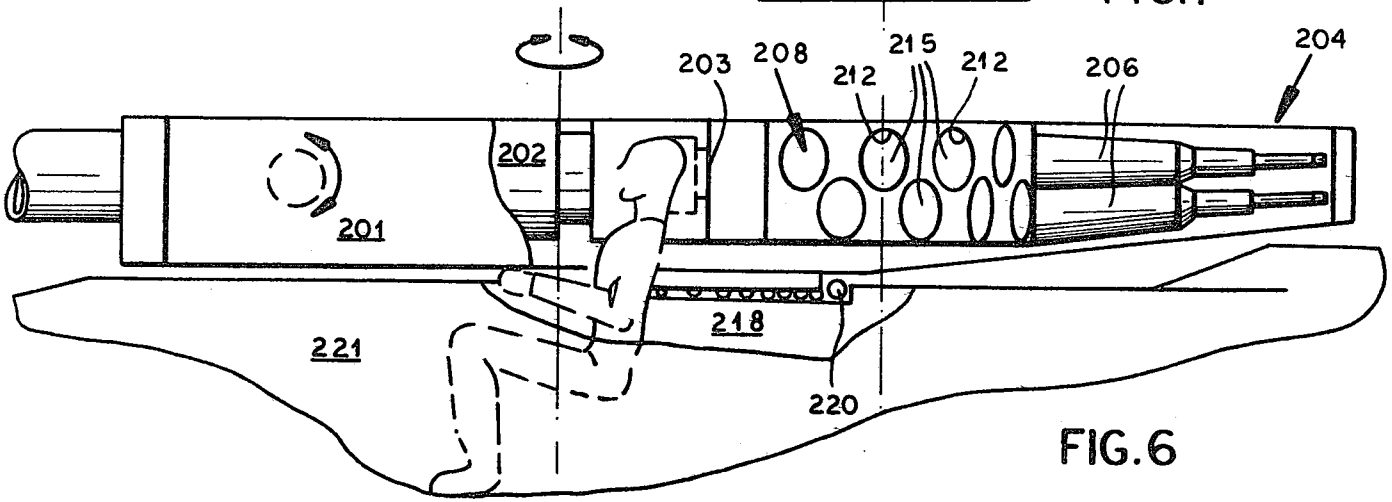
FIG. 6 is a side elevational view, partly in section along the line VI—VI of FIG. 5.

In the embodiment of FIGS. 5 through 7, a turret 201 has its breach mechanism 202 diametrically shown to be provided with a breach opening 203, the recoil direction of the weapon being represented by the arrow H.

The opening 203 is turned toward the rear of the turret in which a munitions magazine 204 is formed in the configuration of an annular sector with radially directed munitions-holding tubes 205 corresponding to the round compartments previously mentioned. Each round 206 is stored in a respective compartment.

In this embodiment, moreover, the magazine 204 is subdivided into three partial magazines, 204*a*, 204*b*, 204*c* of the same size and hence with the configuration of the annular sectors, separated from one another by radially armored partitions 207.

The tubes 5 have radially inwardly directed openings which surround a cylindrical chamber 212 so that round-removal positions 208 are formed all around at least part of this chamber.

A loading device 209 in the form of a round-receiving tube, similarly opens radially at the chamber 212 and also is aligned with a port 211 closed by a hatch 211*a* so that, when this hatch is opened, the rounds can be fed as shown for the round 206' in the direction of arrow L into the loading device and thereby distributed to the tubes 205.

The loading opening 203 of the cannon is also turned toward the chamber 212 which is provided with a loading tube 213 which can be vertically shifted in the housing 214 of this device. The housing 214 substantially fills the chamber 212 and provides a buffer against explosion of a round within the chamber protecting the crew compartment in the region 217' at which the armored partition 217 is interrupted. The armored partition 217 separates the crew compartment 218 from the munitions compartment 219.

The loading device can also be swingable about an axis transverse to the vertical axis as described in connection with the previous embodiments or tiltable as shown by arrow M about an axis N perpendicular to the axis of the loading tube.

The loading tube 213 can be removed from the chamber 212 so that reloading of the tubes 205 can be effected by hand. This also facilitates maintenance of the loading device.

The housing 214 is provided with a recess 216 which permits recoil of the cannon. Rotation of the loading device and the like can be effected by any conventional servomotor system.

The housing 214, with the exception of the loading tube, is armored and the partition 217 is likewise armored. The outer walls of the magazine 204 can also be armored.

In FIG. 6, we have shown the turret 201 with the loading device 213 (FIG. 7) removed. The turret can be mounted on the body 221 of a tank in a rotary column arrangement represented at 220 as is conventional with such turrets.

The munitions 206 in this embodiment are shown to lie at substantially two levels 215 and because of the convergence of the rounds 206, the axis can be inclined somewhat to the horizontal, thereby allowing the profile of the magazine to be tapered (FIG. 6).

This taper is provided by inclining the lower wall of the rear of the turret upwardly which permits raising the engine compartment of the tank, an especially important advantage.

The triangular spaces left around the magazine can be used to store additional munition rounds or munitions for secondary weapons such as machine guns.

The loading tube in this embodiment can also be of the telescoping type, see the aforementioned copending application or German application No. 2,818,279.

As has also been illustrated in FIG. 5, the tubes 5 can be united into sectoral units which can be replaced en bloc for prepackaged insertion of the rounds in the turret.

We claim:

1. In a tank having a rotatable turret provided with a barrel-type weapon swingable in a vertical plane of said turret, a magazine containing a multiplicity of round to be supplied to said weapon, and a loading device adapted to remove the round from said magazine and transfer it to said weapon, said turret being formed with a crew compartment and a munitions compartment, said munitions compartment containing said magazine and said device, said weapon terminating in said crew compartment, the improvement wherein:

said munitions compartment is confined to a rear portion of said turret;

said crew compartment occupies a forward portion of said turret;

said magazine has the configuration of at least one annular nonrotatable sector receiving said rounds with said rounds turned toward a centrum of said sector in a chamber partly surrounded by said sector, said sector being oriented horizontally in said turret and being swingable on said turret with said weapon for traversing said weapon, and said sector having at least one layer of rounds lying substantially at the level of said opening in a horizontal position of said weapon;

said weapon has a breach turned toward said chamber;

said loading device comprises a rotatable body in said chamber and means on said body selectively alignable with said rounds in said magazine and with said breach for withdrawing rounds from said magazine and then inserting them into said breach;

an armored partition being provided between said compartments having a hole aligned with said opening in a horizontal position of said weapon whereby rounds can be fed through said hole; and means including an armored cover being provided in said turret for closing said hole.

2. The improvement defined in claim 1 wherein said sector is provided with a plurality of round compartments opening generally radially toward said centrum at said chamber.

3. The improvement defined in claim 1 wherein said rounds are stored in said sector substantially horizontally and said sector is substantially horizontal.

4. The improvement defined in claim 1 wherein said magazine includes a plurality of such sectors, separable from one another and replaceable in said magazine.

5. The improvement defined in claim 1 wherein said magazine is formed from a plurality of such sectors separated by armored partitions.

6. The improvement defined in claim 1, further comprising a housing for said magazine, said housing being formed with a loading opening alignable with said loading device and communicating therewith through a loading tunnel.

7. The improvement defined in claim 6 wherein said rounds are stored in said sector in respective tubes, said tunnel being formed by one of said tubes.

8. The improvement defined in claim 1 wherein said device is removable from said chamber and said housing.

9. The improvement defined in claim 1 wherein said sector is enclosed in armored walls except in the portion thereof turned toward said chamber.

10. The improvement defined in claim 1 wherein said device includes a loading tube, further comprising means for raising and lowering said loading tube in said chamber.

11. The improvement defined in claim 1 wherein said device is tiltable about an axis perpendicular to the longitudinal axis of said loading device.

12. The improvement defined in claim 1 wherein said device is formed with a recess adapted to be aligned with said weapon to permit recoil thereof.

13. The improvement defined in claim 1 wherein said device includes a loading tube and said enclosure is formed as a single unit removable from said chamber and replaceable therein.

14. The improvement defined in claim 1 wherein said housing converges rearwardly, said rounds being presented rearwardly in said sector.

15. The improvement defined in claim 1 wherein said device includes a turntable rotatable about a vertical axis, at least one loading tube swingably mounted on said turntable for pivoting movement about a horizontal axis parallel to said loading tube.

16. The improvement defined in claim 15 wherein said device is provided with a pair of interconnected and jointly swingable loading tubes.

17. The improvement defined in claim 15 wherein said loading tube is telescopically extensible.

18. The improvement defined in claim 1 wherein armored buffer compartments are provided along the flanks of said turret.

19. The improvement defined in claim 18 wherein said buffer compartments interrupt said sector.

20. The improvement defined in claim 1, further comprising means for separating said munitions compartment from said crew compartment upon detection of a dangerous condition in said munitions compartment.

* * * * *